US007536760B2

(12) United States Patent
Ohsugi

(10) Patent No.: US 7,536,760 B2
(45) Date of Patent: May 26, 2009

(54) ROTARY CUTTING APPARATUS

(75) Inventor: Yasuhiro Ohsugi, Hiroshima (JP)

(73) Assignee: NKG Co., Ltd., Hiroshima (JP)

( * ) Notice: Subject to any disclaimer, the term of this patent is extended or adjusted under 35 U.S.C. 154(b) by 646 days.

(21) Appl. No.: 11/261,857

(22) Filed: Oct. 27, 2005

(65) Prior Publication Data

US 2006/0260457 A1 Nov. 23, 2006

(30) Foreign Application Priority Data

May 19, 2005 (JP) ..... 2005-146989
May 19, 2005 (JP) ..... 2005-146990

(51) Int. Cl.
*D06C 13/00* (2006.01)

(52) U.S. Cl. ..... 26/7; 26/11; 26/15 R; 30/133

(58) Field of Classification Search ..... 26/7, 26/10 C, 8 C, 8 R, 9, 11, 12, 15 R, 16; 30/133, 30/205, 43.6, 41, 41.5, 41.6, 34.2, 263; 83/861, 83/100, 177, 487, 483, 491, 508, 591, 168, 83/169; 15/344, 246.2, 256.52, 339
See application file for complete search history.

(56) References Cited

U.S. PATENT DOCUMENTS 1,335,450 A * 3/1920 Mittelholzer ..... 26/11
1,649,172 A * 11/1927 Mason ..... 26/15 R
1,859,094 A * 5/1932 Katzenmoyer ..... 26/11
1,860,528 A * 5/1932 Buesser ..... 26/7
1,895,843 A * 1/1933 Boyd ..... 26/11
2,802,260 A * 8/1957 Allen ..... 30/41.5
2,916,821 A * 12/1959 Witmer ..... 30/41.5
2,980,994 A * 4/1961 Stachon ..... 30/133
3,279,023 A * 10/1966 Zobel ..... 26/7
3,872,539 A * 3/1975 Doyel ..... 15/344
4,186,889 A 2/1980 Black et al.
4,281,457 A * 8/1981 Walton, II ..... 30/124

(Continued)

FOREIGN PATENT DOCUMENTS

JP 07-88797 4/1995
JP 2002-125592 5/2002

OTHER PUBLICATIONS extended European Search Report, dated Aug. 8, 2006, Application No. 06009552.8.

*Primary Examiner*—Amy B Vanatta
(74) *Attorney, Agent, or Firm*—Hamilton, Brook, Smith & Reynolds, P.C.

(57) ABSTRACT

In a rotary cutting apparatus, including a rotary blade having a cutting blade on the outer circumference and rotating radially in one direction; a housing for accommodating the rotary blade; and a fixed blade in the form of a plate attached to the housing along the outer circumference of the rotary blade, for cutting objects protruding from the blade holes of the fixed blade into the housing by the function of the cutting blade of the rotary blade that comes into slide-contact with the inner surface of the fixed blade, the fixed blade is supported at only one end by hooking one edge of the fixed blade on an upstream side in a rotation direction of the rotary blade onto a hook protrusion, and attached so that it is freely displaceable in an in-plane direction and a direction crossing the plane.

9 Claims, 10 Drawing Sheets

U.S. PATENT DOCUMENTS 4,788,769 A * 12/1988 Maruyama ..... 30/133
4,899,442 A * 2/1990 Horii et al. ..... 30/133
4,985,999 A * 1/1991 Iwasaki et al. ..... 30/133
D314,642 S * 2/1991 Ying ..... D28/50
5,623,745 A * 4/1997 Stanek ..... 15/339
D472,024 S * 3/2003 Caldwell ..... D32/32

* cited by examiner

ROTARY CUTTING APPARATUS

RELATED APPLICATION(S)

This non-provisional application claims priority under 35 U.S.C. §119(a) on Patent Application No. 2005-146989 filed in Japan on May 19, 2005 and Patent Application No. 2005-146990 filed in Japan on May 19, 2005, the entire contents of which are hereby incorporated by reference.

BACKGROUND OF THE INVENTION

1. Field of the Invention

The present invention relates to a rotary cutting apparatus for use in cutting and removing objects such as pills created on the surface of a textile product.

2. Description of Related Art

Textile products such as clothes and carpets have the problem that fibers on their surface are gathered into pills by the function of friction applied during use and deteriorate the appearance of the products. Conventionally, a rotary cutting apparatus aiming at cutting and removing such pills has been proposed (see, for example, Japanese Patent Application Laid-Open No. 07-88797 (1995)).

This rotary cutting apparatus comprises a rotary blade rotating radially in a housing, and a fixed blade in the form of a thin plate attached to cover an opening formed in the housing along the outer circumference of the rotary blade. A cutting blade extending in an axial direction is attached on the outer circumference of the rotary blade, and a plurality of through-holes (blade holes) having a blade part on the periphery thereof are formed throughout the length and breadth of the fixed blade so that the cutting blade and the blade holes come into slide-contact with each other on the rotating circumference of the rotary blade and perform a cutting function.

The rotary cutting apparatus thus constructed is used by placing the outer surface of the fixed blade covering the opening of the housing on the surface of a textile product on which pills are created and rotating the rotary blade. Hence, the pills are received in the blade holes disposed in the fixed blade, protrude toward the inside, and are cut by the function of the cutting blade of the rotary blade that comes into slide-contact with the blade holes.

Further, in the rotary cutting apparatus disclosed in the Japanese Patent Application Laid-Open No. 07-88797 (1995), the housing is connected to a dust sucking hose of a vacuum cleaner so that intake of air into the dust sucking hose is performed through the opening formed in the housing, and the rotary blade is constructed as an impeller that generates rotational force by the function of intake air.

According to this structure, a power source to be used exclusively for rotating the rotary blade is not required, and the reception of pills in the blade holes of the fixed blade is facilitated by the function of intake air. It is therefore possible to surely achieve the purpose of removing pills of the textile product with a simple structure. Moreover, since the cut pills are sucked and collected by the dust sucking hose together with the intake air, no post process is required, and improved handling is achieved.

In order to surely cut the pills received by the blade holes with the rotary cutting apparatus constructed as described above, it is important to bring the cutting blade attached to the circumferential surface of the rotary blade into slide-contact with the inner surface of the fixed blade having the blade holes, without clearance therebetween.

However, since the fixed blade is a thin plate fixed and supported along the opening of the housing and the housing is a molded product made of resin for which it is hard to obtain high accuracy of form, it is difficult to perform assembling by eliminating a clearance between the cutting blade of the rotary blade and the blade holes of the fixed blade.

The rotary cutting apparatus constructed to cut an object between the rotary blade having a cutting blade on the outer circumference and the fixed blade in the form of a thin plate having blade holes has been put into practical use as an electric shaver. In this kind of shaver, the clearance between the cutting blade and the blade holes is eliminated as much as possible by improving the molding precision and processing precision of the fixed blade, and satisfactory cutting performance is realized by reliable cutting.

However, since a rotary cutting apparatus constructed to cut and remove pills created on the surface of a textile product may be used for large-area textile products such as carpets, the size of the fixed blade is inevitably large as well as the rotary blade and the housing. Thus, similarly to the shaver, it is difficult to eliminate the clearance by improving the molding and processing precisions of the fixed blade.

Further, in the rotary cutting apparatus constructed as described above, the rotary blade is a molded product made of resin comprising a central boss part and a plurality of vanes attached at equal intervals on the circumference of the boss part, and rotational force is generated by causing the intake air to function on the vanes.

However, since the rotational force actually obtained by such a rotary blade is light rotational force regardless of the rotation speed, pills may not be surely cut between the cutting blade on the circumference of the rotary blade and the blade holes of the fixed blade, and there is a possibility that the pills may remain without being cut. In particular, when the rotary cutting apparatus is used for a textile product on which many pills are created, the pills remaining without being cut may be caught between the cutting blade and the blade holes and may interfere with the rotation of the rotary blade. Further, such pills may stop the rotation of the rotary blade, and may cause the problem that the process of pulling out the caught pills must be performed in order to continue the cutting operation.

Although this problem is lessened by adopting a large-diameter rotary blade, if the large-diameter rotary blade is used, the size of the housing for accommodating the rotary blade becomes larger, and thus this is not a desirable measure. Moreover, even when the rotation speed of the rotary blade is increased extremely, the rotation speed will be gradually decreased by the pills entering continuously from the blade holes of the fixed blade, and finally the rotation will be stopped. In this case, unpleasant noise (wind noise) is generated by the rotary blade rotating at a high speed.

SUMMARY OF THE INVENTION

The present invention has been made with the aim of solving the above problems, and it is an object of the present invention to provide a rotary cutting apparatus capable of surely cutting objects protruding from the blade holes by improving the condition of attaching a fixed blade for covering an opening of the housing formed along the outer circumference of a rotary blade so that the blade holes formed in the fixed blade and the cutting blade attached to the rotary blade are brought into slide-contact with each other without clearance therebetween.

Another object of the invention is to provide a rotary cutting apparatus capable of performing a reliable and stable cutting function by an improved rotary blade capable of generating large rotational force by the function of intake air.

A rotary cutting apparatus according to a first aspect of the invention is a rotary cutting apparatus comprising: a rotary blade having a cutting blade on an outer circumference and rotating radially in one direction; a housing accommodating the rotary blade; and a fixed blade in a plate form attached to an opening formed in the housing along the outer circumference of the rotary blade, the fixed blade having a plurality of blade holes aligned lengthwise and breadthwise, wherein objects protruding from the blade holes to an inner surface of the fixed blade are cut by a function of the cutting blade of the rotary blade that comes into slide-contact with the inner surface, and the fixed blade is supported at only one end by hooking one edge on an upstream side in a rotation direction of the rotary blade onto a peripheral part of the opening, and attached so that it is freely displaceable in an in-plane direction and a direction crossing the plane.

In this invention, the fixed blade is attached so that it is freely displaceable in the in-plane direction and the direction crossing the plane by hooking only its upstream side in the rotation direction of the rotary blade, and slide-contact between the cutting blade and the fixed blade on the circumference of the rotary blade is caused by the following displacement of the fixed blade corresponding to a change in the slide-contact position so as to surely and stably perform cutting at the slide-contact position.

A rotary cutting apparatus according to a second aspect of the invention is characterized by further comprising supporting protrusions provided near the one edge and near other edge located apart from the one edge, respectively, to face an outer surface of the fixed blade with a clearance therebetween, wherein an outward displacement of the fixed blade is allowed by tilting or bending the fixed blade by using only a contact with one or both of the supporting protrusions as a support.

In this invention, the fixed blade that is displaced outward in slide-contact with the cutting blade of the rotary blade is supported by bringing the fixed blade into contact with one or both of the supporting protrusions provided to face the fixed blade near the edge on the hooked side and the edge on the opposite side, respectively, and the following outward displacement of the fixed blade is surely caused by tilting the fixed blade under the function of one supporting protrusion, or bending it under the function of both of the supporting protrusions, to realize a satisfactory slide-contact state.

A rotary cutting apparatus according to a third aspect of the invention is characterized in that the supporting protrusions extend over substantially an entire width of the one edge or the other edge.

In this invention, the supporting protrusions are brought into contact with the fixed blade over the entire width to stabilize the position of the fixed blade being supported by the supporting protrusions, and the following displacement of the fixed blade is surely caused.

A rotary cutting apparatus according to a fourth aspect of the invention is characterized in that the housing has a connection part to a dust sucking pipe of a vacuum cleaner, and the rotary blade is constructed as an impeller that is rotated by a function of intake air sucked into the dust sucking pipe.

In this invention, the rotary blade is constructed as an impeller and rotated by the function of intake air into the dust sucking pipe, and therefore there is no need to provide a drive source exclusively for the rotary blade.

A rotary cutting apparatus according to a fifth aspect of the invention is a rotary cutting apparatus comprising: a rotary blade having a cutting blade on an outer circumference and rotating radially in one direction; a housing accommodating the rotary blade and connected to a dust sucking pipe of a vacuum cleaner; and a fixed blade in a plate form attached to an opening formed in the housing along the outer circumference of the rotary blade, the fixed blade having a plurality of blade holes aligned lengthwise and breadthwise, wherein objects protruding from the blade holes to an inner surface of the fixed blade are cut by a function of the cutting blade of the rotary blade rotated by a function of intake air into the dust sucking pipe, and the rotary blade has a plurality of weights provided at substantially equal intervals on a rotating circumference.

In this invention, a plurality of weights are provided at equal intervals on the rotating circumference of the rotary blade to increase the inertia moment of the rotary blade, increase the rotational force of the rotary blade caused by the function of intake air and obtain heavy rotational force, thereby realizing reliable cutting between the cutting blade on the outer circumference of the rotary blade and the blade holes of the fixed blade without increasing the size and speed of the rotary blade.

A rotary cutting apparatus according to a sixth aspect of the invention is characterized in that each of the weights defined in the fifth aspect is positioned between a plurality of vanes attached to the rotary blade to give rotational force by the function of intake air.

In this invention, since the weight is positioned between a plurality of vanes attached to the rotary blade, the weights can be easily positioned at equal intervals on the rotating circumference by using an excess space.

A rotary cutting apparatus according to a seventh aspect of the invention is characterized in that each of the weights defined in the sixth aspect is in a plate form and also functions as a vane for giving rotational force to the rotary blade by the function of intake air.

In this invention, by attaching the weights in the form of a plate at equal intervals on the rotating circumference of the rotary blade and causing the weights to also function as vanes for giving rotational force to the rotary blade by the function of intake air, the toque of the rotary blade is further increased by the mutual function with the original vanes.

In the rotary cutting apparatus according to the first aspect of the invention, since the fixed blade attached with only the support of the hooked edge on the upstream side in the rotation direction of the rotary blade is displaced in an in-plane direction and a direction crossing the plane following a rotation of the rotary blade, it is possible to surely and stably cut an object by the slide-contact with the cutting blade on the outer circumference of the rotary blade. Moreover, it is not necessary to excessively increase the processing and mounting precisions of the fixed blade for that, and it is also possible to apply the present invention to a large apparatus.

In the rotary cutting apparatus according to the second aspect, since the fixed blade that is displaced outward by a rotation of the rotary blade is supported by the supporting protrusions in contact with the fixed blade at the limited two positions, the following displacement of the fixed blade is surely caused by tilting the fixed blade in a state being supported by only one supporting protrusion, or bending it in a state being supported by both of the supporting protrusions, and it is possible to realize a satisfactory slide-contact state with the cutting blade on the outer circumference of the rotary blade.

In the rotary cutting apparatus according to the third aspect, since the supporting protrusions extend over the entire width of the fixed blade, the position of the fixed blade being supported by the supporting protrusions is stable, and it is possible to satisfactorily maintain the slide-contact state with the cutting blade on the outer circumference of the rotary blade.

In the rotary cutting apparatus according to the fourth aspect, the housing accommodating the rotary blade is connectable to the dust sucking pipe of a vacuum cleaner, and the rotary blade constructed as an impeller is used. Therefore, the rotary blade can be rotated by the function of intake air into the dust sucking pipe, and the present invention has advantageous effects, for example, it can simplify the structure of the rotary cutting apparatus by eliminating the need of a drive source exclusively for the rotary blade, such as a motor.

In the rotary cutting apparatus according to the fifth aspect, since the inertia moment of the rotary blade is increased by arranging a plurality of weights at equal intervals on the rotating circumference of the rotary blade, the rotational force of the rotary blade caused by the function of intake air is increased, and it is possible to surely and stably perform cutting between the cutting blade on the outer circumference of the rotary blade and the blade holes of the fixed blade. Moreover, such cutting is realized without increasing the rotation speed of the rotary blade, and it is possible to reduce wind noise caused by the rotation of the rotary blade.

In the rotary cutting apparatus according to the sixth aspect, since the weight is positioned between the vanes attached to the rotary blade, the weights can be easily positioned at equal intervals by using the excess space.

Moreover, in the rotary cutting apparatus according to the seventh aspect, since the weight positioned between the vanes is in the form of a plate and also functions as a vane, the rotational force of the rotary blade is further increased by the mutual function with the original vanes, and the present invention has advantageous effects, for example, it can realize stable rotation with large rotational force and perform reliable cutting.

The above and further objects and features of the invention will more fully be apparent from the following detailed description with accompanying drawings.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

While this invention has been particularly shown and described with references to preferred embodiments thereof, it will be understood by those skilled in the art that various changes in form and details may be made therein without departing from the scope of the invention encompassed by the appended claims.

Figure 1:
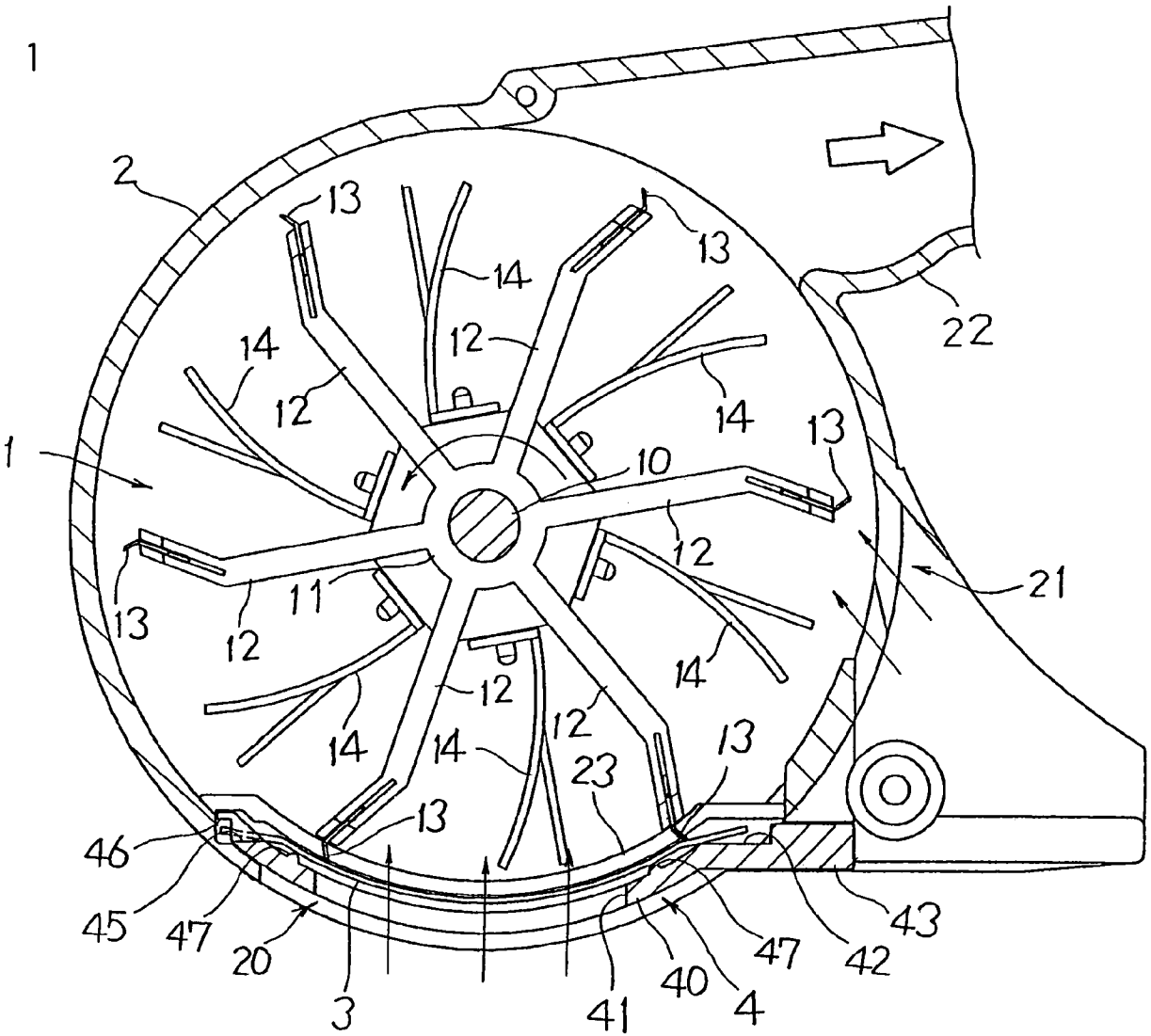
FIG. 1 is a sectional side view of a rotary cutting apparatus of the present invention.

The following description will explain in detail the present invention, based on the drawings illustrating an embodiment thereof. FIG. 1 is a sectional side view of a rotary cutting apparatus of the present invention. As shown in FIG. 1, the rotary cutting apparatus comprises a rotary blade 1, a housing 2 for accommodating the rotary blade 1, and a fixed blade 3 in the form of a plate.

The rotary blade 1 is constructed as an impeller integrally comprising a plurality of (six in FIG. 1) vanes 12, 12 . . . which are arranged at equal intervals in a circumferential direction and protrude outward in a radial direction from a central boss part 11 into which a rotation shaft 10 is fitted. One cutting blade 13 is attached to an end of each of the vanes 12, 12 . . . , and weight plates 14, 14 . . . are attached between the respective vanes 12, 12 . . . .

Figure 2:
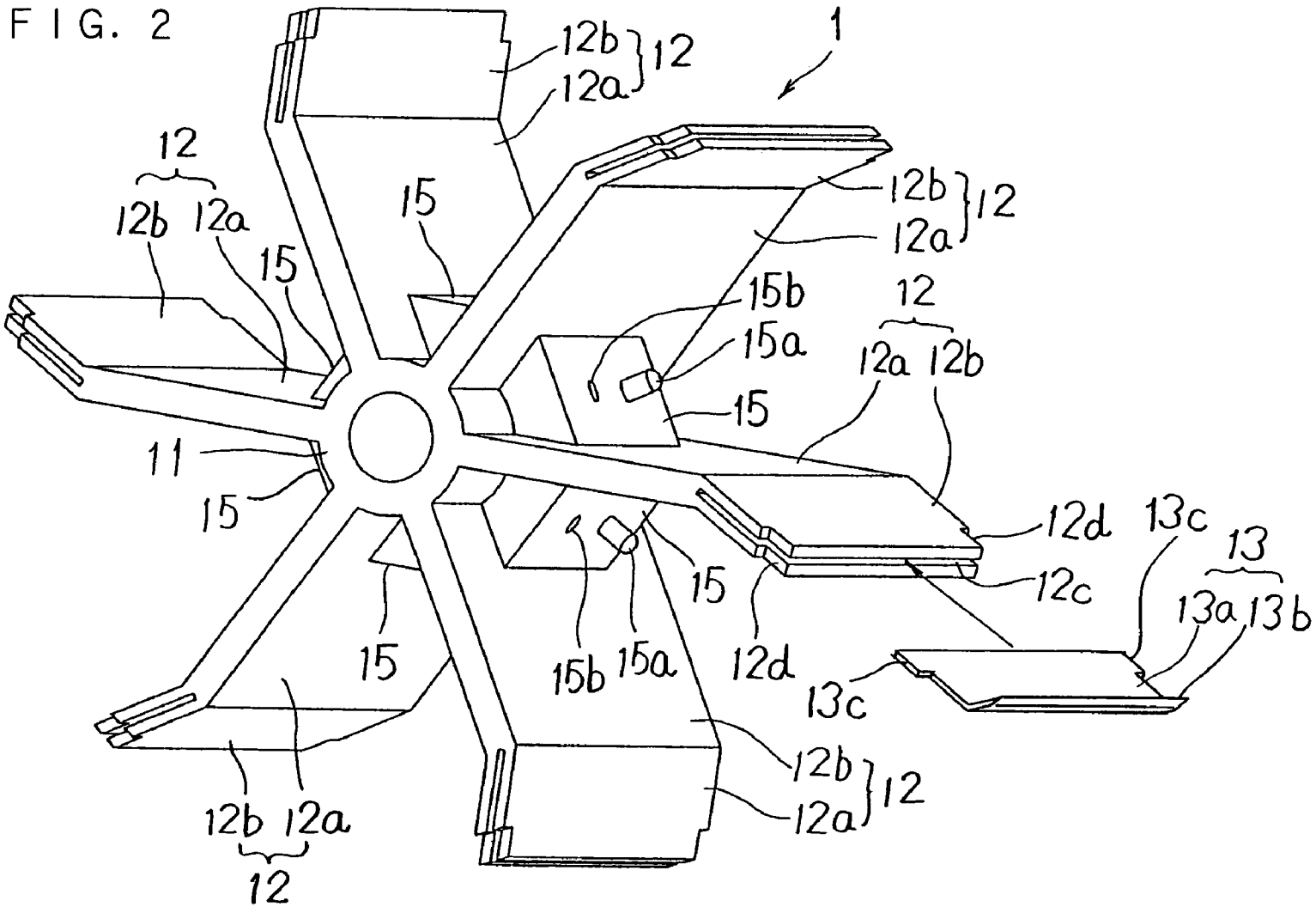
FIG. 2 is an external perspective view of a rotary blade.

FIG. 2 is an external perspective view of the rotary blade 1. As shown in FIG. 2, each of the vanes 12, 12 . . . comprises a leg part 12*a* protruding outward in a radial direction from the boss part 11, and a bent part 12*b* connected to an end of the leg part 12*a* and bent toward one side in a circumferential direction. A slit 12*c* having an opening in an end extends over the entire width of the bent part 12*b*.

The cutting blade 13 attached to such a vane 12 comprises, as shown in FIG. 2, a base part 13*a* in the form of a flat plate with a width substantially equal to the vane 12, and a blade part 13*b* connected to the base part 13*a* and bent to one side. The cutting blade 13 is attached by inserting the base part 13*a* into the slit 12*c* in the end of the vane 12 as shown by the arrow in FIG. 2 so that the orientation of the blade part 13*b* is opposite to the bending direction of the bent part 12*b*.

Further, flange parts 13*c* and 13*c* are provided to protrude outward from both sides of the base part 13*a* of the cutting blade 13, and cutout grooves 12*d* and 12*d* are formed in both sides of the end of the bent part 12*b* of the vane 12 so that the cutout grooves 12*d* and 12*d* are connected to the same circumference between the respective vanes 12, 12 . . . By holding the flange parts 13*c* and 13*c* on both sides with a stopper ring (not shown) wound on the cutout grooves 12*d* and 12*d* to bridge all the vanes 12, 12, the cutting blade 13 inserted into the slit 12*c* of each of the vanes 12 is restrained so that it cannot be pulled out.

Figure 3:
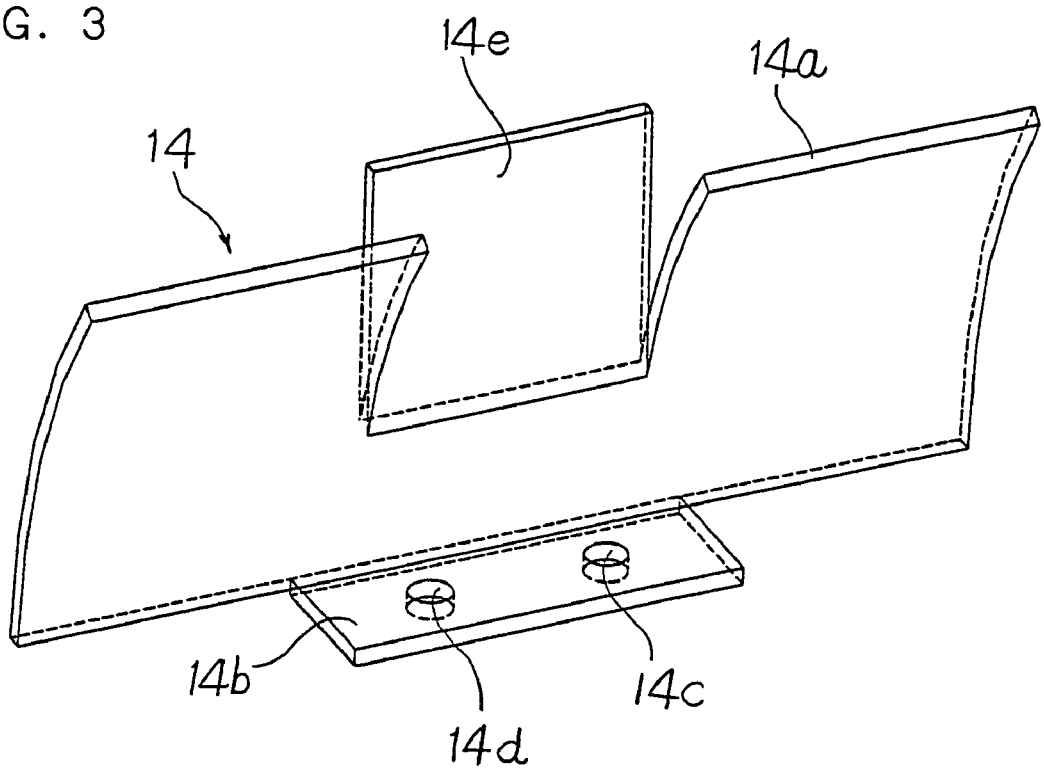
FIG. 3 is an external perspective view of a weight plate.

FIG. 3 is an external perspective view of the weight plate 14. As shown in FIG. 3, the weight plate 14 is a metal plate comprising a main plate 14*a* curved with an appropriate curvature, and a base plate 14*b* connected to substantially the center portion of one edge of the main plate 14*a* and extending inward in a radial direction of a curved circle. In the base plate 14*b*, a positioning hole 14*c* and a fixing hole 14*d* are disposed to pass in a thickness direction through positions separated by a predetermined length in a width direction. Moreover, in the center portion in a width direction of the main plate 14*a*, a relief part 14*e* is formed by cutting a portion corresponding to the width of the positioning hole 14*c* and fixing hole 14*d* and raising it at substantially a right angle to the base plate 14*b*.

As shown in FIG. 2, fixing bases 15, 15 . . . for fixing the above-mentioned weight plates 14, 14 . . . are provided outside the boss part 11 of the rotary blade 1, at substantially the center between the respective vanes 12, 12 . . . in a width direction. The fixing base 15 has a bearing surface substantially orthogonal to the radial direction of the boss part 10. A positioning protrusion 15*a* is formed on one side in the width direction of the bearing surface, and a screw hole 15*b* is formed on the other side.

The interval between the positioning protrusion 15*a* and the screw hole 15*b* is equal to the interval between the positioning hole 14*c* and the fixing hole 14*d* in the base plate 14*b* of the weight plate 14, and the weight plate 14 is fixed to such a fixing base 15 by fitting the positioning hole 14*c* of the base plate 14*b* on the positioning protrusion 15*a* and fastening a fixing screw 16 (see FIG. 4) into the screw hole 15*b* aligned with the inside of the fixing hole 14*d*, so that the base plate 14*b* is seated on the bearing surface of the fixing base 15.

Figure 4:
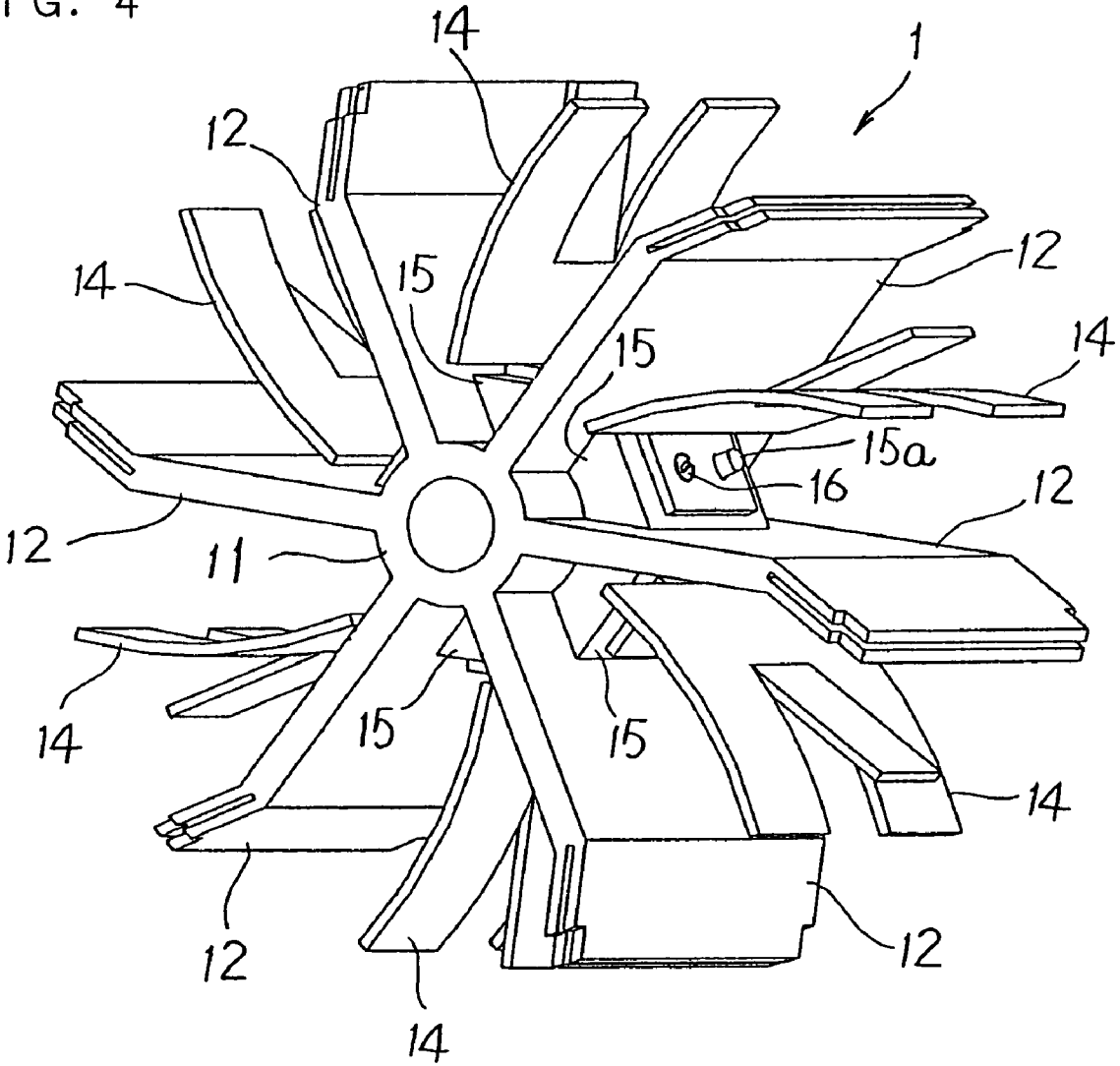
FIG. 4 is an external perspective view of the rotary blade to which the weight plate is fixed.
Figure 5:
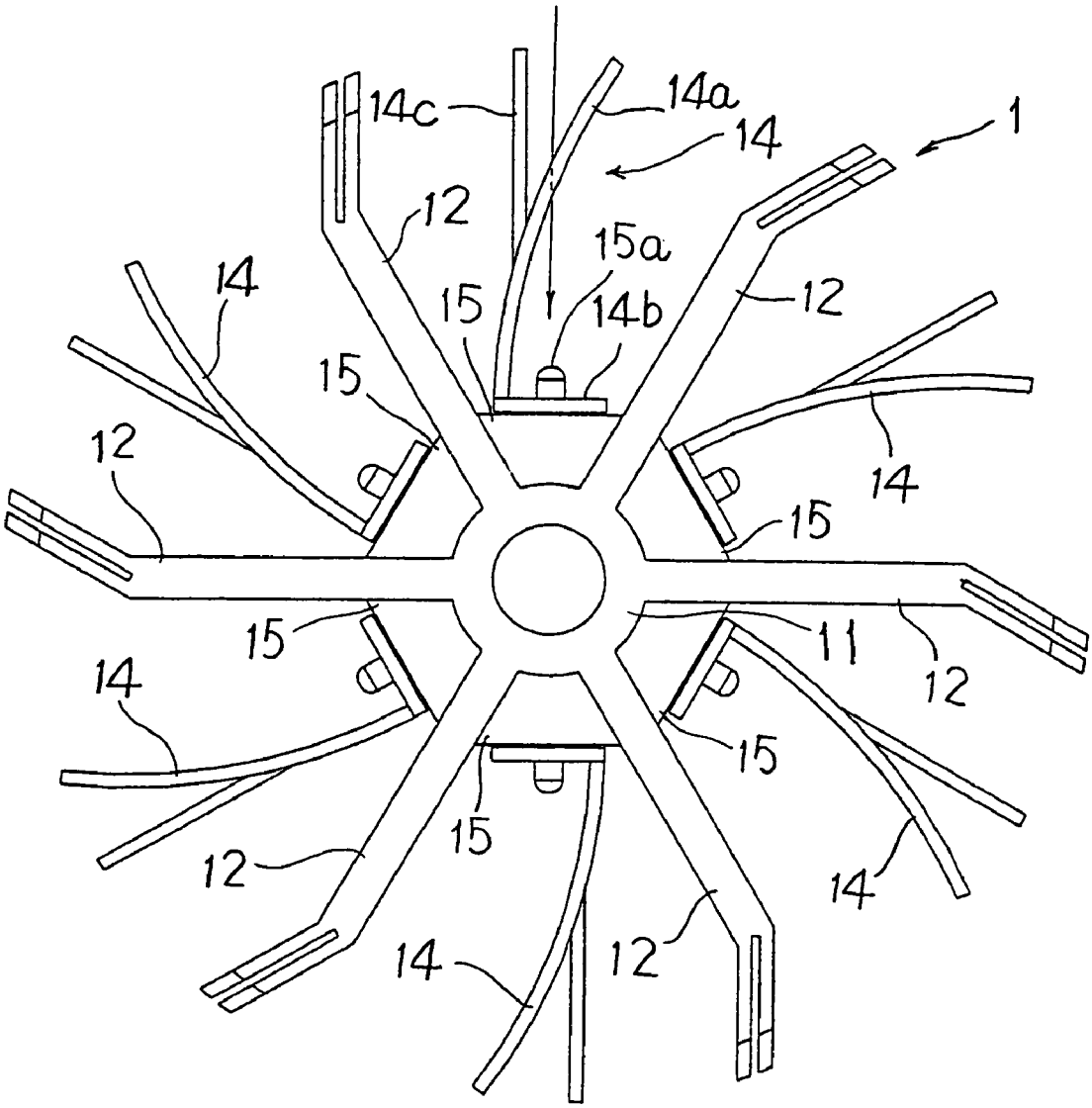
FIG. 5 is a side view of the rotary blade to which the weight plate is fixed.

FIG. 4 is an external perspective view of the rotary blade 1 to which the weight plates 14 are fixed, and FIG. 5 is a side view thereof. As shown in FIGS. 1, 4 and 5, the weight plate 14 is fixed so that the curving direction of the main plate 14*a* is the same direction as the bending direction of the bent part 12*b* of the vane 12. Note that the relief part 14*e* of the weight plate 14 is provided to allow a linear view of the base plate 14*b* between the vanes 12 located next to each other when fixing the weight plate 14 as mentioned above, and to perform the operation of fitting the positioning protrusion 15*a* into the positioning hole 14*c* and fastening the fixing screw 16 into the screw hole 15*b* inside the fixing hole 14*d* by viewing from the periphery of the rotary blade 1 as shown by the arrow in FIG. 5.

Figure 6:
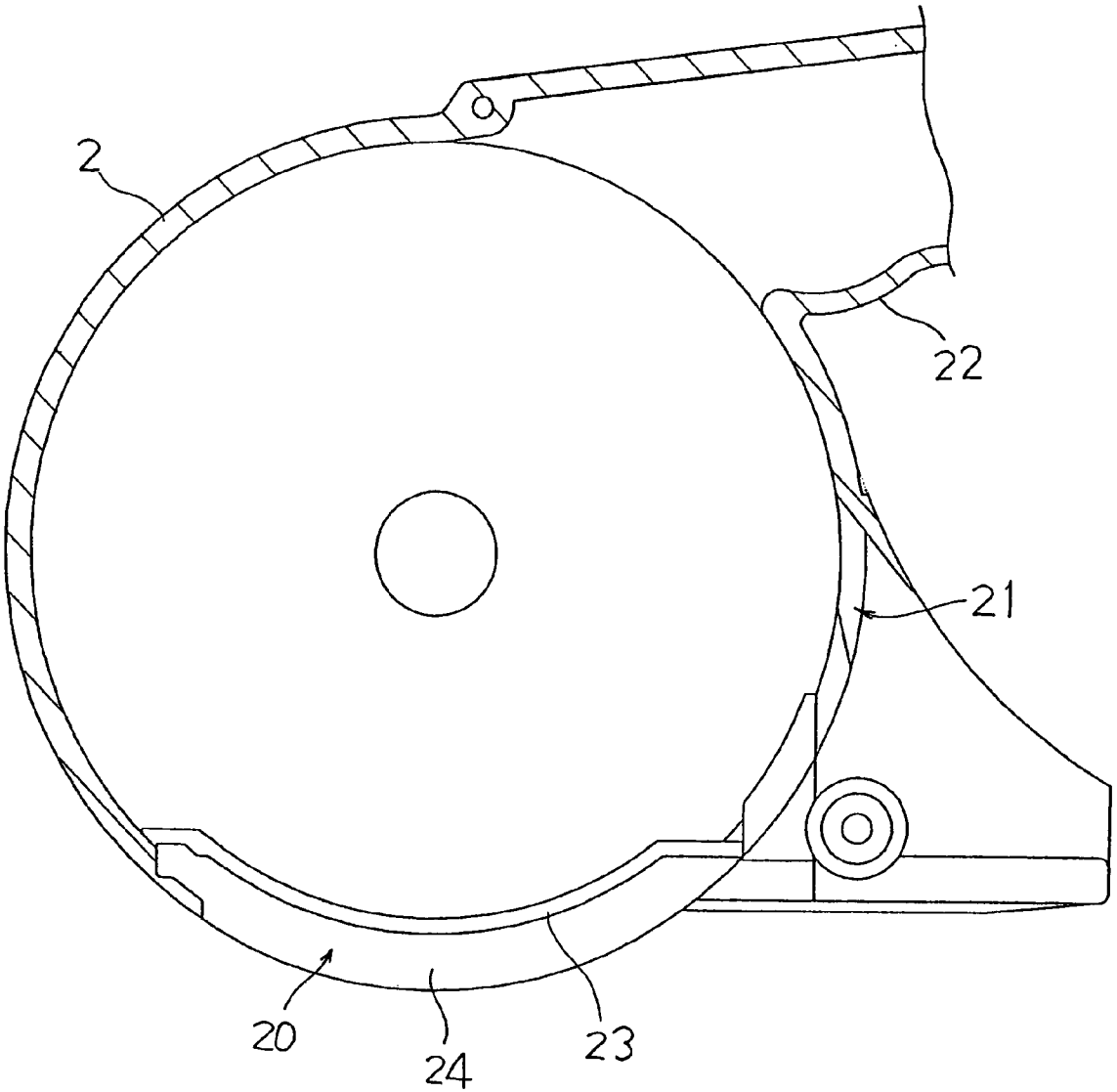
FIG. 6 is a sectional side view of a housing accommodating the rotary blade.

FIG. 6 is a sectional side view of the housing 2 accommodating the rotary blade 1. As shown in FIG. 6, the housing 2 is a cylindrical hollow container with an inner diameter capable of receiving the rotary blade 1 including the cutting blades 13, 13 . . . attached to the ends of the vanes 12, 12 . . . . In the circumferential wall of the housing 2, an attachment opening 20 for attaching the fixed blade 3 as to be described later and an inlet 21 for sucking outside air are formed at positions next to each other in a circumferential direction. On the other side of the attachment opening 20 and inlet 21, a connection pipe 22 for connection to a dust sucking pipe of a vacuum cleaner (not shown) is integrally connected.

Figure 7:
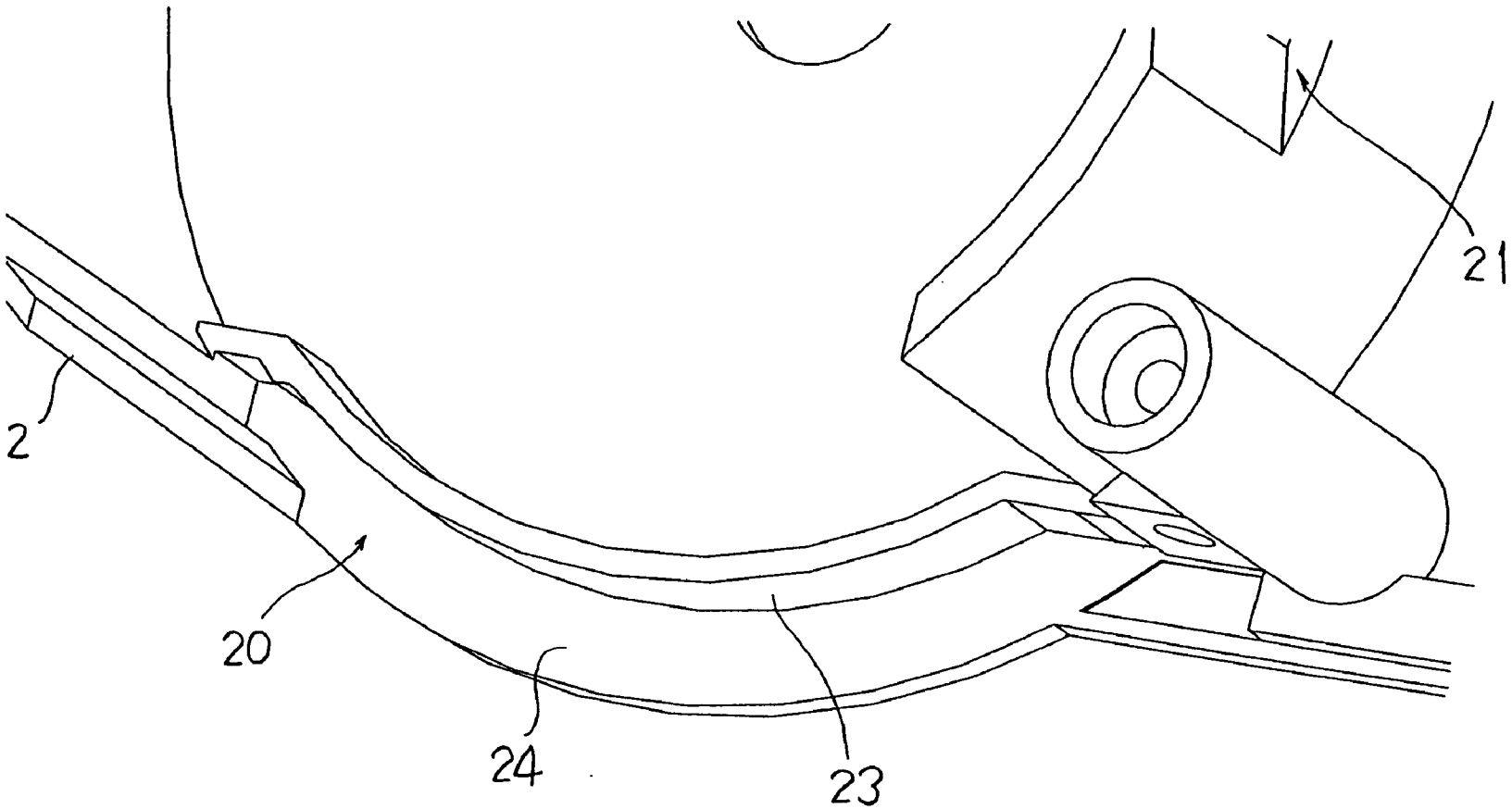
FIG. 7 is an enlarged perspective view showing the vicinity of the position where an opening for attaching a fixed blade is formed.

FIG. 7 is an enlarged perspective view showing the vicinity of the position where the attachment opening 20 for attaching the fixed blade 3 is formed. As shown in FIG. 7, inside the attachment opening 20 formed along the outer circumference of the housing 2, a presser rib 23 curved along the attachment opening 20 is formed with a suitable height protruding from an end wall 24 on the same side. Similarly, this presser rib 23 is provided on an end wall of the housing 2 on the opposite side to FIG. 7, and positioned to border both sides of the attachment opening 20 in the width direction.

Figure 8:
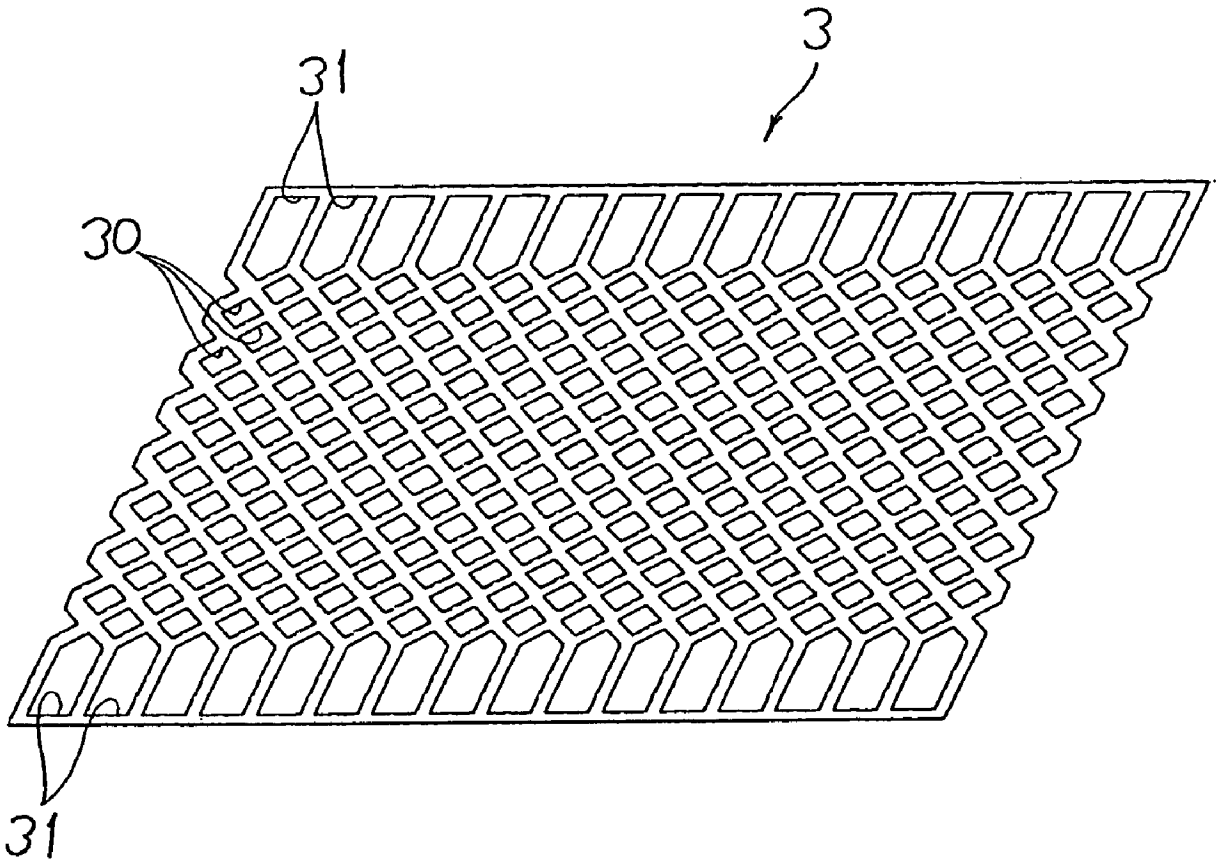
FIG. 8 is an external perspective view of the fixed blade.

The fixed blade 3 is attached to the thus formed attachment opening 20 through a holder 4. FIG. 8 is an external perspective view of the fixed blade 3. As shown in FIG. 8, the fixed blade 3 comprises a large number of blade holes 30, 30 . . . arranged lengthwise and breadthwise over substantially the enter surface of a thin resilient metal plate, and large-area engagement holes 31, 31 . . . are disposed along each edge on both sides of the area where these blade holes 30, 30 . . . are disposed.

Figure 9:
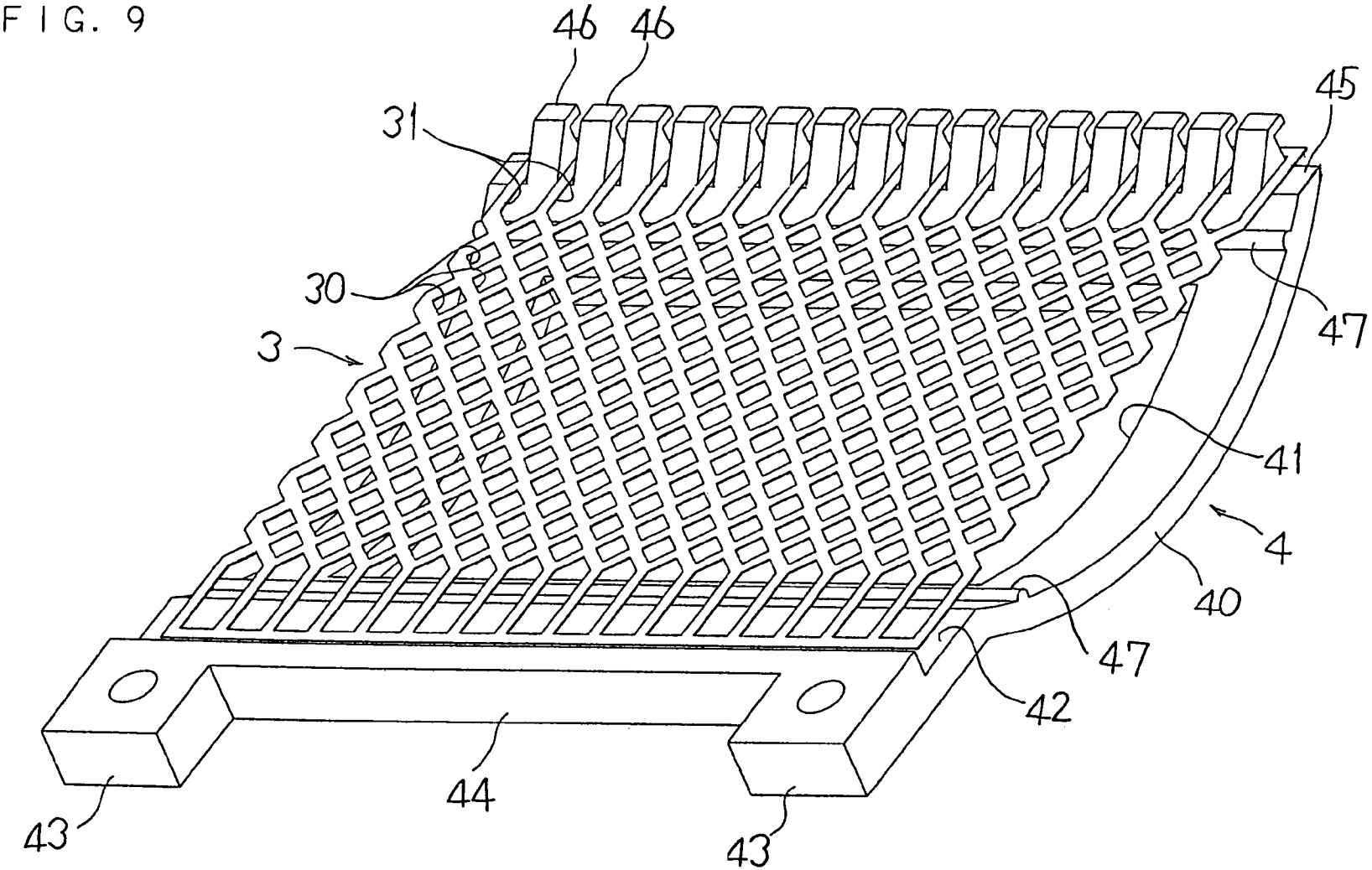
FIG. 9 is an external perspective view showing the state of the fixed blade held by a holder.
Figure 10:
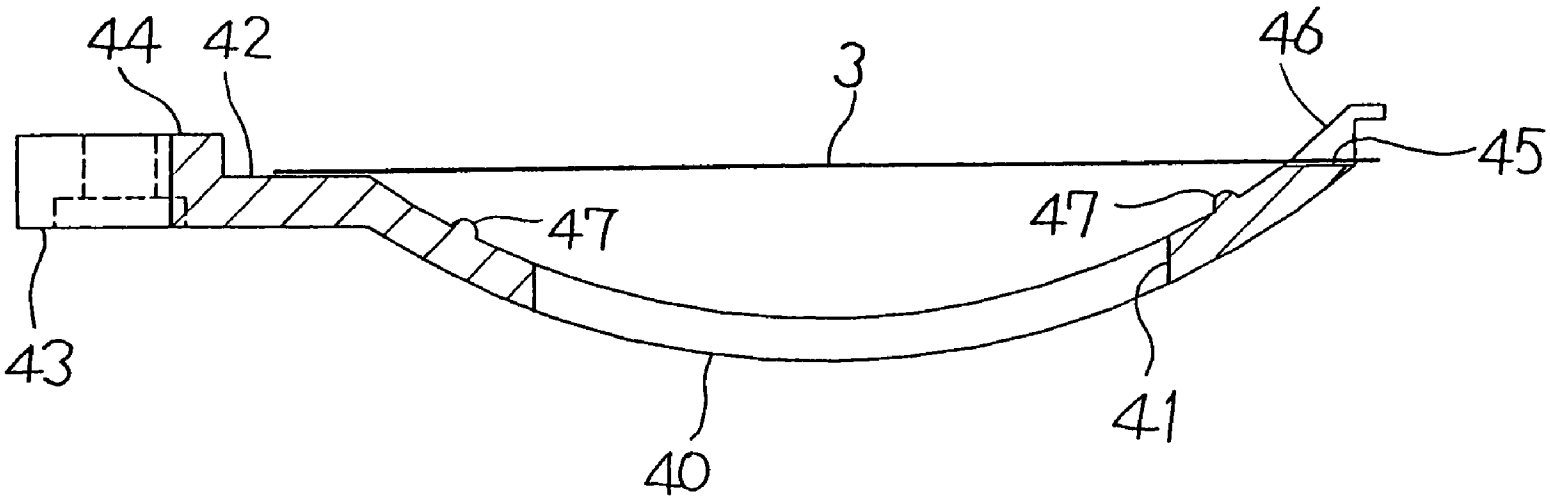
FIG. 10 is a sectional side view showing the state of the fixed blade held by the holder.

FIG. 9 is an external perspective view showing the state of the fixed blade 3 held by the holder 4, and FIG. 10 is a sectional side view of the same. As shown in FIGS. 9 and 10, the holder 4 is a frame body having a rectangular opening 41 formed in the center of a curved portion 40 curved in the shape of an arc with a curvature corresponding to the external shape of the housing 2. A fixing edge 44 comprising fixing brackets 43 and 43 on both sides in the width direction is attached to a flat portion 42 connected to one side of the curved portion 40, and a plurality of hook protrusions 46, 46 . . . are arranged along a flat portion 45 connected to the other side of the curved portion. Each of the hook protrusions 46, 46 . . . has a trapezoid shape with inside thickness decreasing from the base portion toward the end portion, and the end portion is bent outward into a hook shape.

The number and interval of the above-mentioned hook protrusions 46, 46 . . . correspond to the number and interval of the engagement holes 31, 31 . . . of the fixed blade 3, and the fixed blade 3 is held by hooking the engagement holes 31, 31 aligned along the edge on one side onto the hook protrusions 46, 46 . . . and placing the edge on the same side over the flat portion 45 and the edge on the other side over the flat portion 42 as shown in FIGS. 9 and 10.

Moreover, on the inner surface of the curved portion 40 of the holder 4, supporting protrusions 47 and 47 are provided in the vicinity of both edges of the opening 41 extending along the flat portions 42 and 45. As shown in FIG. 10, these supporting protrusions 47 and 47 face the lower surface of the fixed blade 3 having a small-diameter semi-circular cross section and held as described above, and extend over the entire width of the holder 4 as shown in FIG. 9.

As shown in FIG. 1, the holder 4 holding the fixed blade 3 as described above is attached by inserting one side (the flat portion 45 side) into one edge of the attachment opening 20 formed in the housing 2, turning the holder 4 with the inserted end as a pivot so that the arc portion 40 is positioned along the attachment opening 20, and fastening the fixing brackets 43 and 43 provided on the other side (the flat portion 42 side) to the same side of the attachment opening 20 with screws. Consequently, the fixed blade 3 is curved along the opening 41 formed in the arc portion 40 of the holder 4 by the function of the presser ribs 23 and 23 provided on both sides of the attachment opening 20, and attached in the state shown in FIG. 1. At this time, the outer surface of the fixed blade 3 faces the supporting protrusions 47 and 47 provided on the arc portion 40 as described above with an appropriate clearance therebetween.

The fixed blade 3 thus attached is freely displaceable in an in-plane direction within the range of clearance ensured in the hook section between the engagement parts 31, 31 . . . and the hook protrusions 46, 46 . . . . Moreover, in a direction crossing the plane, the fixed blade 3 is freely displaceable within the clearance ensured with respect to the supporting protrusions 47 and 47. Further, even after contact with the supporting protrusions 47 and 47, the fixed blade 3 is freely displaceable by tilting it using the contact point with one of the supporting protrusion 47 as a fulcrum and bending it between the contact positions with both of the supporting protrusions 47 and 47.

The rotary cutting apparatus of the present invention constructed as described above is used by placing the fixed blade 3 attached in the attachment opening 20 as described above on the surface of an object, for example, the surface of a textile product such as a carpet while taking air into the connection pipe 22 as shown by the open arrow in FIG. 1 by connecting the connection pipe 22 of the housing 2 to the dust sucking pipe of a vacuum cleaner and operating the vacuum cleaner.

The inside of the housing 2 is connected to the outside through the inlet 21 formed in the circumferential wall and the opening 41 formed in the holder 4 of the fixed blade 3. In the case where the intake of air is performed as described above, outside air is sucked into the housing 2 through the inlet 21 and the opening 41 as shown by the arrow in FIG. 1, the flow of the intake air strikes the vanes 12, 12 . . . of the rotary blade 1 supported inside the housing 2, and the rotary blade 1 is rotated in a counterclockwise direction.

Moreover, with the intake air through the opening 41, protrusions from the surface of an object, for example, pills created on the surface of a carpet, on which the fixed blade 3 covering the opening 41 is placed are sucked, and enter into the housing 2 from the blade holes 30, 30 . . . of the fixed blade 3. At this time, in the housing 2, the rotary blade 1 is rotated by the function of intake air, and the cutting blades 13, 13 . . . attached to the outer circumference of the rotary blade 1, that is, the ends of the respective vanes 12, 12 . . . , come into slide-contact with the inner surface of the fixed blade 3 one after another. Therefore, the protrusions such as pills are cut by the mutual function of the blade holes 30, 30 . . . from which they protrude and the cutting blades 13. Note that pieces of the object cut in such a manner are sucked into the dust sucking pipe together with the intake air through the connection pipe 22, and collected in a dust collecting section of the vacuum cleaner connected to the dust sucking pipe.

In the rotary cutting apparatus of the present invention, the fixed blade 3 is supported at only one end by hooking one edge on the upstream side in a rotation direction of the rotary blade 1 onto the hook protrusions 46, 46 . . . of the holder 4, and attached so that it is freely displaceable in an in-plane direction and a direction crossing the plane without restraining any other parts. The fixed blade 3 thus attached first comes into contact with the cutting blade 13 on the outer circumference of the rotary blade 1 on the hook side, and is then displaced by a combination of the above-mentioned displacements following a movement of the cutting blade 13 corresponding to the rotation of the rotary blade 1. Therefore, slide-contact between the blade holes 30, 30 . . . formed in substantially the entire surface of the fixed blade 3 and the cutting blade 13 of the rotary blade 1 is always performed satisfactorily, and the above-mentioned cutting at the slide-contact section can be surely and stably performed.

Moreover, since such a slide-contact state is maintained by tilting the fixed blade 3 while being supported by one of the supporting protrusions 47, 47, or bending the fixed blade 3 while being supported by both of the supporting protrusions 47 and 47 as mentioned above, it is not necessary to excessively improve the accuracy of form and mounting precision of the fixed blade 3. Consequently, it is possible to perform satisfactory and stable cutting by a large rotary cutting apparatus that is used on the premise that it is connected to the dust sucking pipe of a vacuum cleaner. Further, if the present invention is applied to a small rotary cutting apparatus such as a shaver, it can contribute to a reduction in the product cost by relaxing the processing and mounting precisions.

Since the supporting protrusions 47 and 47 supporting the fixed blade 3 during operation as described above extend over the entire width of the fixed blade 3, the position of the fixed blade 3 is stabilized by the support of these supporting protrusions 47 and 47 over the entire width. In addition, since the supporting protrusions 47 and 47 are just in line contact with the fixed blade 3 at their positions, the possibility that they may interfere with the displacement of the fixed blade 3 in an in-plane direction is small, and it is possible to surely displace the fixed blade 3 following the rotation of the rotary blade 1.

The above-described embodiment has illustrated the case where the rotary blade 1 is constructed as an impeller that produces rotational force by the function of intake air into the housing 2. However, needless to say, the present invention is also applicable to a rotary cutting apparatus comprising a rotary blade 1 rotated by the transmission of power from a rotation drive source such as a power motor.

In the rotary cutting apparatus of the present invention, the rotary blade 1 that rotates in the above-mentioned manner has weight plates 14, 14 . . . positioned between a plurality of vanes 12, 12 . . . and arranged at equal intervals on the rotating circumference. These weight plates 14, 14 . . . are heavy metal plates, and positioned apart from the center of rotation because they are fixed to the fixing bases 15, 15 . . . provided on the boss part 11, and therefore the rotary blade 1 has a large inertia moment.

Consequently, the rotation of the rotary blade 1 caused by the function of intake air to the vanes 12, 12 . . . is a heavy rotation caused stably with large rotational force, and the above-mentioned cutting between the cutting blade 13 and the blade holes 30, 30 . . . of the fixing blade 3 on the circumference of the rotary blade 1 is surely performed without leaving almost any uncut portions. For example, even when the present invention is applied to textile products on which many pills are created, it is possible to perform a reliable and stable cutting function. Further, since such cutting is realized without excessively increasing the rotation speed of the rotary blade 1, it is possible to reduce wind noise caused by the rotation and perform a quiet operation.

The inertia moment of the rotary blade 1 can be increased by attaching weights at equal intervals in a circumferential direction, at positions distant from the center of rotation of the rotary blade 1. However, as described in the embodiment, by attaching the weights 14, 14 . . . between the vanes 12, 12 . . . , the weights are effectively arranged using an excess space, and it is possible to minimize the change in the rotation balance of the rotary blade 1 caused by the attachment of the weight plates 14, 14 . . . .

Further, since the weight plates 14, 14 . . . comprise the main plates 14*a*, 14*a* . . . curved in the same direction as the bent parts 12*b*, 12*b* . . . at ends of the vanes 12, 12 the intake air sucked through the inlet 21 and the opening 41 functions inside the curved circle of the main plates 14*a*, 14*a* . . . , and rotational force is given to the rotary blade 1. Thus, since each of the weight plates 14, 14 . . . also functions as a vane, it is possible to rotate the rotary blade 1 more stably.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims

What is claimed is:

1. A rotary cutting apparatus comprising:

a rotary blade having a cutting blade on an outer circumference and rotating radially in one direction;

a housing accommodating the rotary blade; and a fixed blade in a plate form attached to an opening formed in the housing along the outer circumference of the rotary blade, the fixed blade having a plurality of blade holes aligned lengthwise and breadthwise, wherein objects protruding from the blade holes to an inner surface of the fixed blade are cut by a function of the cutting blade of the rotary blade that comes into slide-contact with the inner surface, and the fixed blade is supported at only one end by hooking one edge on an upstream side in a rotation direction of the rotary blade onto a peripheral part of the opening, and attached so that it is freely displaceable in an in-plane direction and a direction crossing the plane.

2. The rotary cutting apparatus according to claim 1, further comprising supporting protrusions provided near the one edge and near other edge located apart from the one edge, respectively, to face an outer surface of the fixed blade with a clearance therebetween, wherein an outward displacement of the fixed blade is allowed by tilting or bending the fixed blade by using only a contact with one or both of the supporting protrusions as a support.

3. The rotary cutting apparatus according to claim 2, wherein the supporting protrusions extend over substantially an entire width of the one edge or the other edge.

4. The rotary cutting apparatus according to claim 3, wherein the housing has a connection part to a dust sucking pipe of a vacuum cleaner, and the rotary blade is constructed as an impeller that is rotated by a function of intake air sucked into the dust sucking pipe.

5. The rotary cutting apparatus according to claim 2, wherein the housing has a connection part to a dust sucking pipe of a vacuum cleaner, and the rotary blade is constructed as an impeller that is rotated by a function of intake air sucked into the dust sucking pipe.

6. The rotary cutting apparatus according to claim 1, wherein the housing has a connection part to a dust sucking pipe of a vacuum cleaner, and the rotary blade is constructed as an impeller that is rotated by a function of intake air sucked into the dust sucking pipe.

7. A rotary cutting apparatus comprising:

a rotary blade having a cutting blade on an outer circumference and rotating radially;

a housing accommodating the rotary blade and connected to a dust sucking pipe of a vacuum cleaner; and a fixed blade in a plate form attached to an opening formed in the housing along the outer circumference of the rotary blade, the fixed blade having a plurality of blade holes aligned lengthwise and breadthwise, wherein objects protruding from the blade holes to an inner surface of the fixed blade are cut by a function of the cutting blade of the rotary blade rotated by a function of intake air into the dust sucking pipe, and the rotary blade has a plurality of weights provided at substantially equal intervals on a rotating circumference.

8. The rotary cutting apparatus according to claim 7, wherein each of the weights is positioned between a plurality of vanes attached to the rotary blade to give rotational force by the function of intake air.

9. The rotary cutting apparatus according to claim 8, wherein each of the weights is in a plate form and also functions as a vane for giving rotational force to the rotary blade by the function of intake air.

* * * * *